US006684873B1

(12) United States Patent
Anderson et al.

(10) Patent No.: US 6,684,873 B1
(45) Date of Patent: Feb. 3, 2004

(54) PAINT BALL GUN MAGAZINE WITH TILT SENSOR

(76) Inventors: Joel A. Anderson, 1893 Wildflower Ct., Shoreview, MN (US) 55126; Louis Spicer, 196 Phoenix Ave., Mantua, NJ (US) 08051

( * ) Notice: Subject to any disclaimer, the term of this patent is extended or adjusted under 35 U.S.C. 154(b) by 0 days.

(21) Appl. No.: 10/234,525

(22) Filed: Sep. 4, 2002

(51) Int. Cl.[7] ..... F41B 9/00
(52) U.S. Cl. ..... 124/82; 42/1.01
(58) Field of Search ..... 42/1.01; 124/82

(56) References Cited

U.S. PATENT DOCUMENTS

| | | | | | |
|---|---|---|---|---|---|
| 636,737 | A | | 11/1899 | Bagley | |
| 842,509 | A | | 1/1907 | Woodruff | |
| 1,095,749 | A | | 5/1914 | Tomlinson | |
| 1,226,278 | A | | 5/1917 | Teves | |
| 3,695,246 | A | | 10/1972 | Filippi et al. | |
| 3,789,891 | A | * | 2/1974 | Bosch | 141/331 |
| 4,004,495 | A | | 1/1977 | Belfer | |
| 4,121,365 | A | * | 10/1978 | Hodil | 42/88 |
| 4,457,208 | A | * | 7/1984 | Golden | 89/33.02 |
| 4,472,063 | A | | 9/1984 | Eickelmann | |
| 4,565,183 | A | * | 1/1986 | Smith | 124/26 |
| 4,719,839 | A | * | 1/1988 | Smothers et al. | 89/1.802 |
| 5,052,138 | A | | 10/1991 | Crain | |
| 5,097,816 | A | | 3/1992 | Miller | |
| 5,107,820 | A | * | 4/1992 | Salansky | 124/78 |
| 5,142,805 | A | * | 9/1992 | Horne et al. | 42/1.02 |
| 5,282,454 | A | | 2/1994 | Bell et al. | |
| 5,285,765 | A | | 2/1994 | Lee | |
| 5,327,878 | A | | 7/1994 | Wittbrot | |
| 5,338,025 | A | | 8/1994 | Giovagnoli | |
| 5,402,678 | A | | 4/1995 | Fritz et al. | |
| 5,411,330 | A | | 5/1995 | Arutyunov et al. | |
| 5,425,299 | A | * | 6/1995 | Teetzel | 89/14.4 |
| 5,473,703 | A | | 12/1995 | Smith | |
| 5,487,234 | A | * | 1/1996 | Dragon | 42/70.07 |
| 5,505,188 | A | | 4/1996 | Williams | |
| 5,511,333 | A | | 4/1996 | Farrell | |
| 5,553,857 | A | | 9/1996 | Fish | |
| 5,605,461 | A | | 2/1997 | Seeton | |
| 5,634,278 | A | * | 6/1997 | London | 42/132 |
| 5,642,581 | A | * | 7/1997 | Herold et al. | 42/1.02 |
| 5,688,048 | A | | 11/1997 | Duckworth | |
| 5,791,325 | A | | 8/1998 | Anderson | |
| 5,824,942 | A | * | 10/1998 | Mladjan et al. | 89/41.17 |
| 5,947,100 | A | | 9/1999 | Anderson | |
| 6,109,252 | A | | 8/2000 | Stevens | |
| 6,170,380 | B1 | * | 1/2001 | Bender-Zanoni et al. | 89/45 |
| 6,408,905 | B1 | * | 6/2002 | Lee | 42/70.01 |
| 6,412,207 | B1 | * | 7/2002 | Crye et al. | 42/70.06 |

* cited by examiner

*Primary Examiner*—Michael J. Carone
*Assistant Examiner*—Denise J Buckley
(74) *Attorney, Agent, or Firm*—Albert W. Watkins

(57) ABSTRACT

A paint ball gun includes an agitator mounted on the end of a rotary motor shaft. Rotational direction of the motor shaft is controlled by an electronic circuit responsive to a tilt sensor. The inclusion of tilt sensor provides an enhanced paint ball gun capable of operating optimally during periods of gun tilt. Several preferred magazine designs incorporating the tilt sensor are illustrated. An additional double-rotation of the motor is disclosed which enables short bursts of oppositely directed agitator rotation, which frees any jams that may occur. These short bursts may be triggered manually, electronically responsive to a sensed condition indicative of a jam, or through a timed interval. The paint ball gun is capable of rapidly firing more paint balls under otherwise sub-optimal conditions than previously known in the art.

9 Claims, 7 Drawing Sheets

PAINT BALL GUN MAGAZINE WITH TILT SENSOR

BACKGROUND OF THE INVENTION

1. Field of the Invention

This invention pertains generally, though not exclusively, to paint ball guns used for recreational and training purposes. For the purposes of this disclosure, paint ball guns are specifically defined as apparatus that propel paint capsules from a barrel in rapid succession and at relatively high speeds. The paint ball capsules are designed to break upon impact with an object or person, thereby rendering an identifiable mark without injuring the person or object. The present invention more specifically pertains to an electronically controlled magazine that stores and feeds paint balls into a firing chamber.

2. Description of the Related Art

Paint ball guns can fire in rapid succession a relatively large number of paint balls in a short period of time. A magazine stores the paint balls until the balls are delivered to the gun firing chamber. The guns use compressed gas as the propellant, and are usually triggered by a user squeezing a conventionally shaped gun trigger. When the gun user repeatedly squeezes the trigger, the gun should continue to fire paint balls as rapidly as possible. Guns may be manually loaded before each shot, but most are either semi-automatic, where each time the trigger is pulled a paint ball is fired, or fully automatic, where the balls are fired as quickly as the gun is capable of for as long as the trigger is pulled.

Quite unlike conventional explosive-propelled munitions, current paint balls are relatively round and have an exterior formed from a semi-rigid gelatinous compound. The gelatinous compound is known to be affected by such variables as temperature and relative humidity, and is of course somewhat frangible. During a firing sequence, paint balls on occasion lodge against each other or other objects and block the passageway to the firing chamber, resulting in a jam. While jamming is not new, knowledge from explosive munitions magazines is of little use with the very different paint balls.

Basic paint ball magazines are little more than large hoppers with a feed tube extending therefrom, a sort of closed funnel through which paint balls are dropped into the firing chamber. Unfortunately, the passageway must ultimately taper to isolate single paint balls therein. Usually this is not a gradual taper, but a sudden transition, to reduce the likelihood of two balls getting stuck against each other. Unfortunately, when one paint ball does lodge against the other, the user must shake the gun to free the balls.

One method of preventing paint ball jams is proposed by Miller in U.S. Pat. No. 5,097,816. Therein, a large helical magazine is provided through which the paint balls pass in a single row, eventually leading to the firing chamber. Unfortunately, the Miller design does not use space efficiently, requiring a large helical path with the center portion thereof unused. The extra dimension is undesirable. Furthermore, because of the reduced slope of the surfaces heading into the firing chamber, actual feed rates may be reduced and paint balls may not be provided at speeds sufficient to meet the needs of the more rapidly firing guns. Cleaning of the Miller construction, which is necessary over time to ensure smooth feeding of the paint balls, is difficult also due to the inaccessibility of the central loops of the helix.

Farrell in U.S. Pat. No. 5,511,333 also illustrates a magazine designed not to jam. Unfortunately, the straight tube design severely limits the number of balls contained within a single magazine. When a rapid fire sequence is initiated, the gun may not jam, but it is highly probably that the magazine will empty, still rendering the gun temporarily disabled.

U.S. Pat. No. 5,282,454 to Bell et al, incorporated herein by reference, discloses a large magazine with sloping ends and side walls that lead downward to a tubular passageway referred to as a feed tube. Gravitational forces tend to urge the paint balls to the feed tube, as known in the prior art. The magazine is large, capable of holding many paint balls at a time. The feed tube is connected to the firing chamber of the gun, so that as the paint balls are carried through the tube, they are fed into the firing chamber. Occasionally, a pair of paint balls will simultaneously drop into the opening of the feed tube so that neither can pass, leading to a jam.

To prevent jamming of this type, the Bell et al patent proposes an agitator paddle to stir the paint balls. The agitator paddle may slightly overlap the feed tube opening. In addition to directly clearing any jams at the feed tube opening, the agitator paddle also keeps other paint balls within the magazine moving and available for feeding through the tube. Even if the gun is tilted slightly, the agitator paddle will tend to stir the balls and encourage them to move around, with the increased likelihood that they will continue to pass into the feed tube.

Since the agitator paddle is driven by a small DC motor, batteries are required. Unfortunately, the battery drain is significant. To preserve the battery during periods of non-use, as well as ensure that a user may stay quiet absent the sounds of the motor and agitator, Bell et al disclose an optical sensor within the feed tube which detects an absence of paint balls at a point within the tube. When no ball is present, an electronic circuit triggers the motor to spin the agitator. As soon as a paint ball blocks the optical path, the motor is again stopped.

While the Bell et al design enhances the rate at which paint balls may pass into the feed tube and has enhanced the sport, improved guns and occasional mishaps have revealed limitations therein.

For example, the simple paddle shown in the Bell et al patent, while helpful, still does not ensure sufficient feed rates for newer model guns. To overcome this feed rate limitation, newer designs include higher power motors propelled by twice as many batteries. The standard model agitator is propelled by a single nine volt battery, while the enhanced version is propelled by two nine volt batteries. In addition, the paddle has been redesigned to have four flat surfaces extending longitudinally parallel with the motor shaft and radially therefrom, equidistantly spaced at 90 degree intervals. While this model improves the feed rate significantly, the added weight and cost of the additional battery is certainly undesirable. Furthermore, the added size of the battery compartment makes the gun an easier target for an opponent to hit.

Williams, in U.S. Pat. No. 5,505,188 discloses a coiled tube within the magazine chamber that is pressurized during the firing process to force balls into the feed tube. During rapid fire sequences, the magazine is certainly agitated by motion of the coiled tube. However, the coiled tube does not positively clear the feed tube opening and so can, in some instances, actually create a jam at the feed tube inlet.

Stevens, in U.S. Pat. No. 6,109,252, the contents which are incorporated herein by reference, discloses an improved paint ball carrier which receives paint balls in pockets around the periphery thereof. A guide assembly improves the orderly feeding of balls into an opening.

Anderson, one of the present inventors, in U.S. Pat. Nos. 5,791,325 and 5,947,100 incorporated herein by reference, discloses a paint ball gun including an improved agitator which delivers higher paint ball feed rates than other prior art agitators. Illustrated in those patents are various novel features, combinations, and sub-combinations, the listing herein in summary form not to be interpreted as defining, restricting or limiting the actual contents of those patents, but instead the contents and teachings of these patents are incorporated herein by reference. Such features and combinations are illustrated therein as an electronic circuit having a duration control which delays turning off the motor for a predetermined interval. The motor remains activated continuously during a rapid firing sequence. In addition, a magnetic, sound, pressure, shock or similar sensor is disclosed to trigger the electronic circuit into energizing the motor. The combination of sensor trigger, duration control and agitator design provide a greatly enhanced paint ball gun capable of operating without jamming or undesired noise during non-firing periods. Nevertheless, even further improved magazine paint ball feed rate and more enhanced performance under a variety of conditions are still desired.

SUMMARY OF THE INVENTION

In a first manifestation of the invention, a controller for a paint ball gun magazine agitator motor includes a tilt sensor which in response to the magazine being tilted generates an electrical direction indicator signal; a tilt duration detector timing the electrical direction indicator signal; and an electrical circuit for controlling a direction of rotation of the paint ball magazine agitator motor responsive thereto.

In a second manifestation of the invention, a tilt activated relay for powering a paint ball magazine agitator comprises means for detecting tilt of the paint ball magazine with respect to gravity, means for timing a duration of detected tilt, means for determining when the time exceeds a threshold; and means for selectively reversing a rotation of the paint ball magazine agitator motor responsive to the determining means.

In a third manifestation of the invention, a method of refilling a paint ball gun magazine feeder tube comprises the steps of detecting magazine tilt; initiating an electrical pulse responsive to the tilt; and activating a paint ball agitator responsive to the tilt and a demand for paint balls, to thereby move paint balls into the feeder tube.

OBJECTS OF THE INVENTION

While the prior art Anderson developments advanced the state of the art, the inventors have discovered that the magazines of the art are sensitive to gun tilt away from vertical, and that this sensitivity can be used advantageously to control paint ball feeding. Exemplary embodiments of the present invention solve inadequacies of the prior art by providing a tilt sensor and control system to change the rotational direction of the agitator responsive to sensed tilt. Additional combinations of magazine and agitator design further benefit the paint ball delivery system.

A first object of the invention is to improve magazine paint ball feed rate. A second object of the invention is to enhance magazine performance under the diverse conditions of a competition or field use. Another object of the present invention is to provide a retro-fit capability to existing guns, to allow upgrade of existing equipment. Yet a further object of the invention is to enable a jammed gun to be reversed, to thereby free the agitator for further use.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
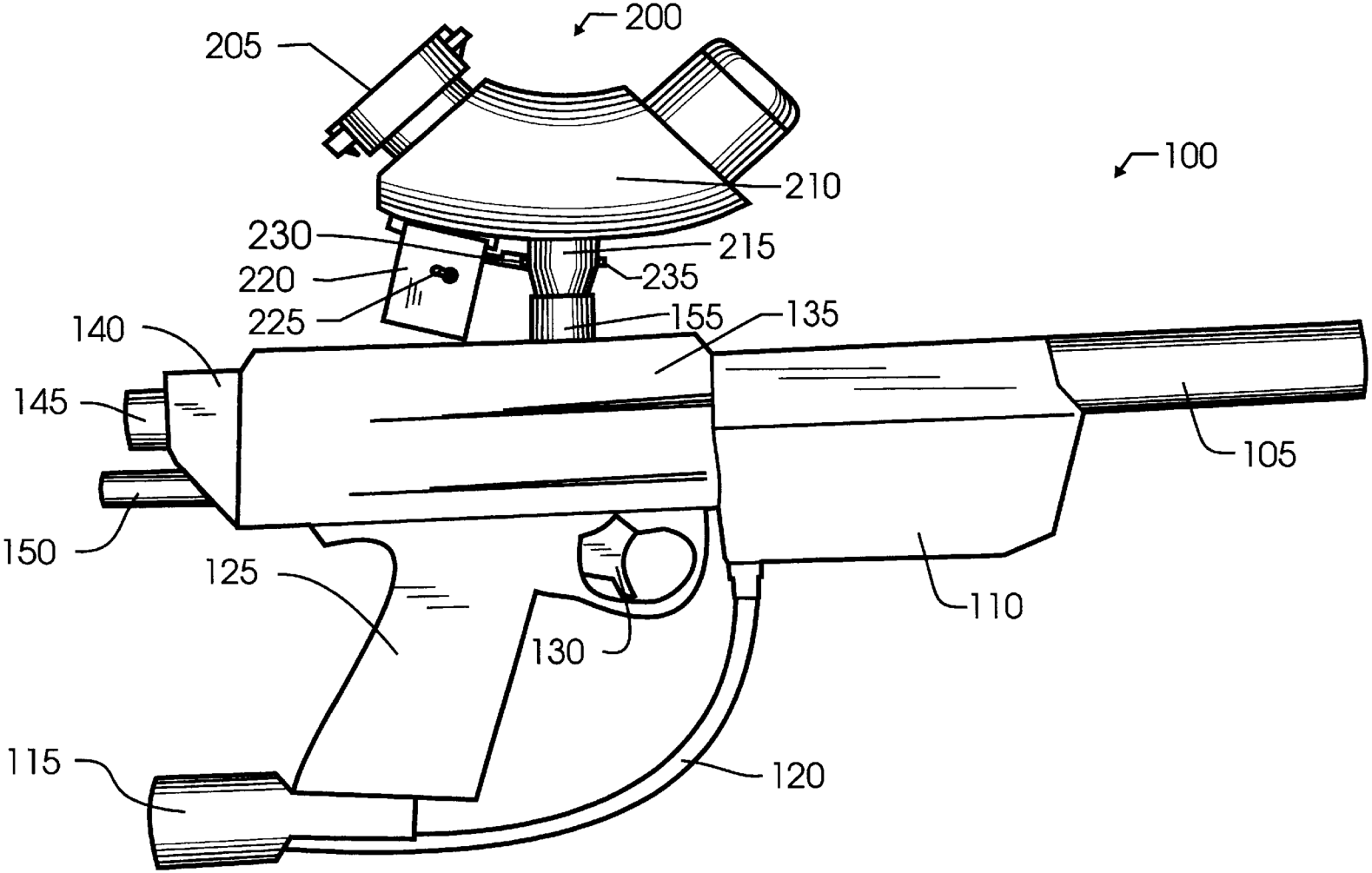
FIGURE 1 (PRIOR ART)
FIG. 1 illustrates a prior art paint ball gun in a ready position from side plan view.

A prior art paint ball gun 100 is shown by side view in a "ready" position in FIG. 1. Gun 100 includes a barrel 105, pressure valve and hand grip 110, pressure tank coupler 115 and hose 120. One hand of a user may support gun 100 at pressure valve cover 110, while the other hand will grip handle grip 125. One finger, usually the pointer, will wrap around trigger 130, and may be used to squeeze trigger 130 to activate the firing process. When trigger 130 is squeezed, movable bolt stop 140, slidable bolt 145 and slidable valve 150 may all be moved away from gun housing 135. The exact sequence and operation of the pressure valve, bolt stop 140, slidable bolt 145 and slidable valve 150 are unimportant to the present invention, well known in the field, and achievable through several known alternatives.

Magazine 200 attaches to paint ball inlet 155 through feed tube 215. Surrounding feed tube 215 is an optical sensor pair 230 and 235, which detect by light wave whether a paint ball is absent at this location within feed tube 215. Connected to sensor pair 230, 235 is a battery, motor and electronics compartment 220 having a power switch 225 for energizing the optical sensors and electronics.

In operation, a user may dispense paint balls into magazine 200 through cover 205, into magazine chamber 210. A source for pressurized gas will be connected to pressure tank coupler 115, and pressurized gas will be conducted through hose 120 into a pressure valve within the gun. Depending upon the particular sensor and circuitry used, the user may next activate the battery, motor and electronics compartment by switching on switch 225. The gun is then in a "ready" state, whereby squeezing trigger 130 will start the firing process. The firing process, through the various techniques described in my prior patents incorporated herein by reference, will ultimately trigger a motor to turn.

Figure 2:
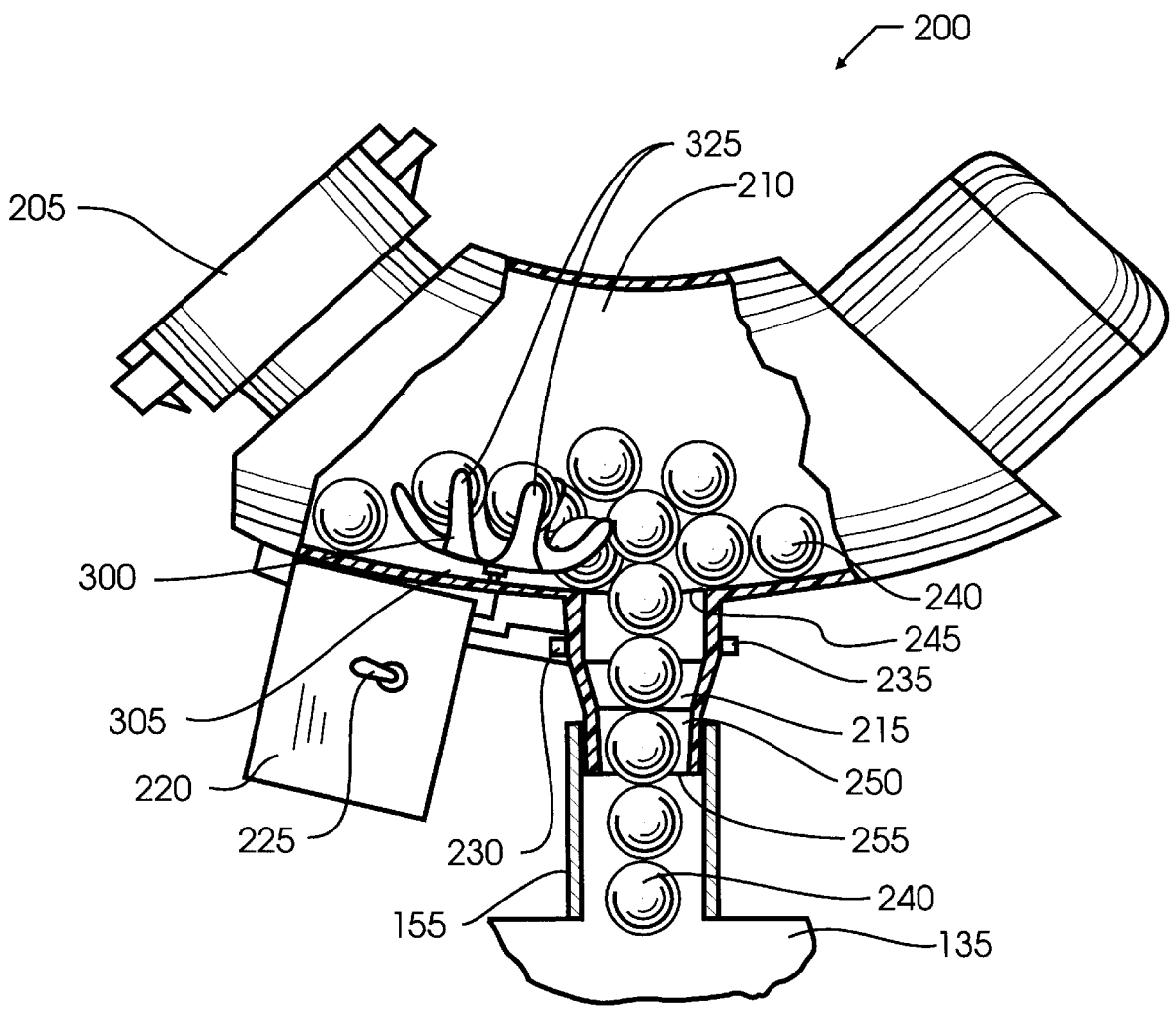
FIG. 2 illustrates a partial cut-away view of a preferred embodiment paint ball magazine in accord with the teachings of the present invention.

FIG. 2 illustrates the magazine of the present invention by partial cut-away view. Within magazine chamber 210 are a number of paint balls 240. Also within chamber 210 is paint ball agitator shaft 300, which is caused to rotate by motor shaft 305. Onto agitator shaft 300 are mounted a plurality of arms 325.

Feed tube 215 forms a sharp transition with magazine chamber 210 at transition 245. In the preferred embodiment, agitator arms 325 overlap with transition 245 slightly, such that if two balls 240 should drop into feed tube 215 simultaneously and get lodged against each other at transition 245, agitator arms 325 will serve to clear one of the balls. Feed tube 215 has a gentle taper 250 therein, which, although not absolutely necessary, helps to maintain exact spacing between magazine 200 and paint ball inlet 155 and helps to support magazine 200.

Figure 3:
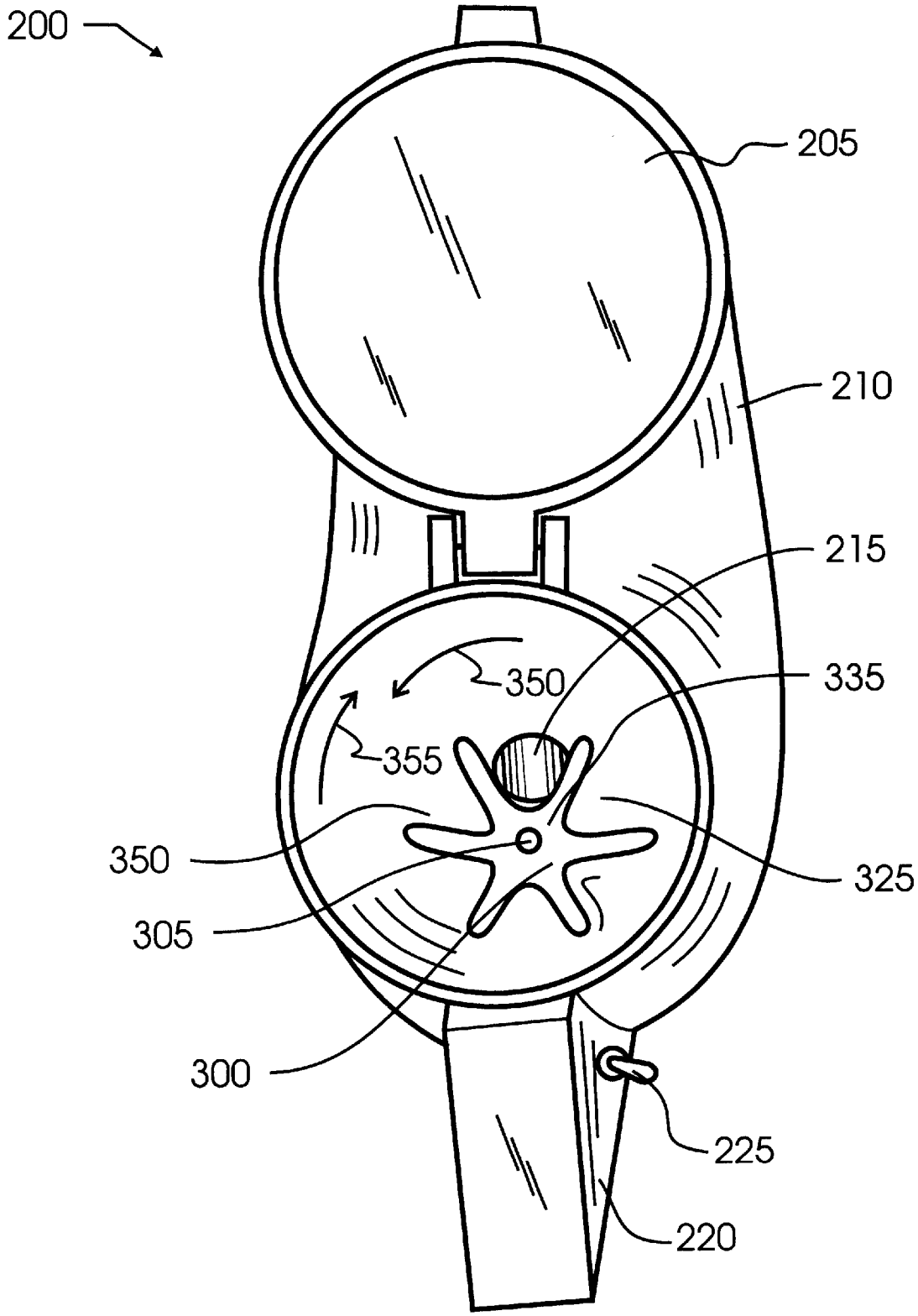
FIG. 3 illustrates a top projected view of the paint ball magazine of FIG. 2, with the cover raised to reveal the agitator features of the preferred embodiment.

FIG. 3 shows a top view of agitator shaft 300, wherein the arrangement of arms 325 are evident. From the perspective shown in FIG. 3, motor shaft 305 rotates in either a clockwise direction shown by arrow 355 or a counter-clockwise direction as illustrated by arrow 350. The present invention is not limited to agitator shaft 300 and arms 325, and may alternatively include a variety of other constructions or arrangements which will serve to accomplish the same function and which are too numerous to specifically mention. Nevertheless, the preferred agitators will be effective regardless of rotation direction, for reasons which will be better understood herein below. In the preferred embodiment, the entire agitator is either polymer or coated with a polymer protectant, which serves to protect the agitator from corrosion, softens impact with paint balls 240, and may provide better surface characteristics therebetween.

Figure 4:
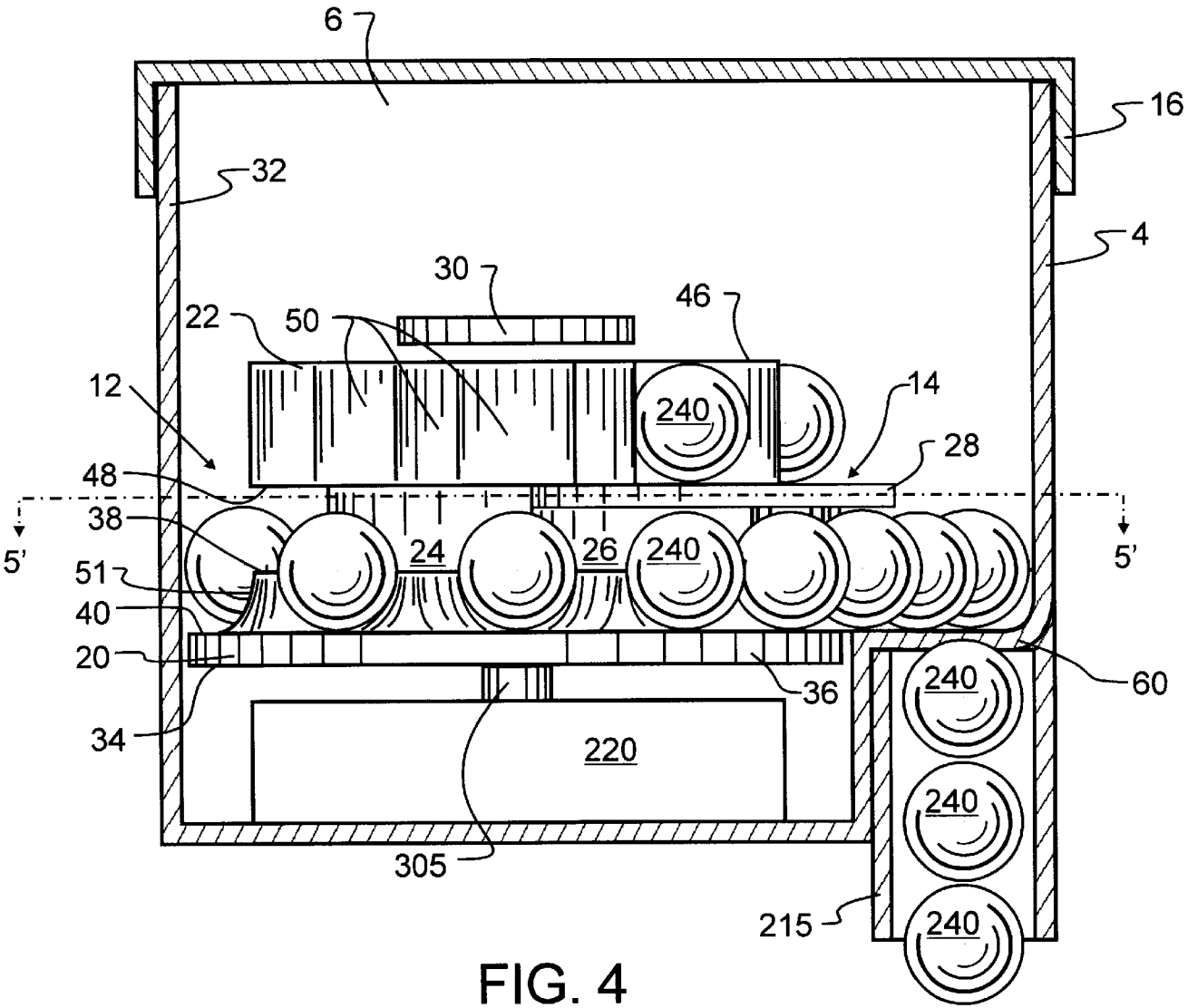
FIG. 4 illustrates a first alternative embodiment magazine by side cross-sectional view.
Figure 5:
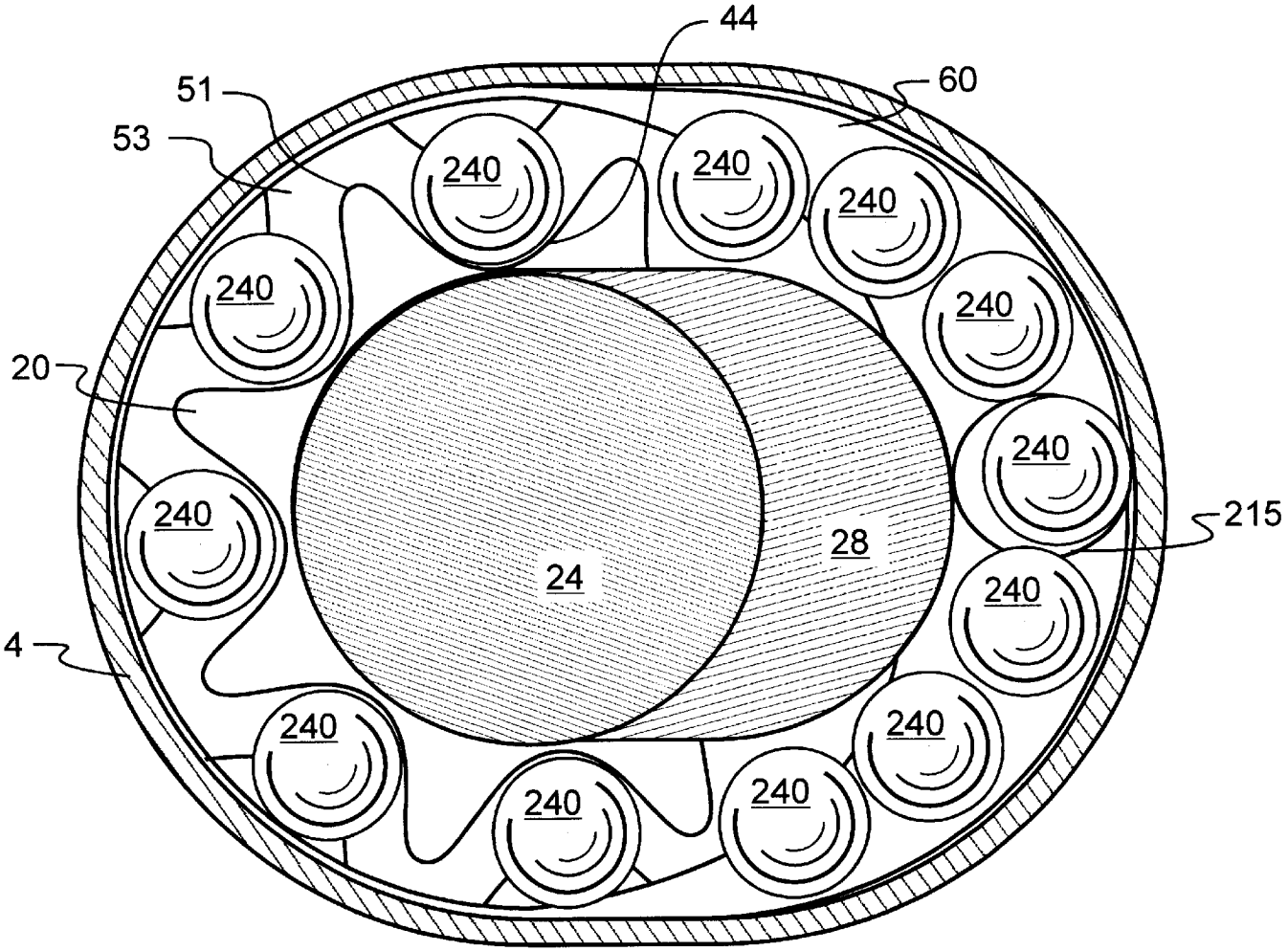
FIG. 5 illustrates the first alternative embodiment magazine from top cross-sectional view.

Referring to FIGS. 4 and 5, there is shown a first alternative embodiment magazine constructed in accord with the teachings of the present invention comprising a generally cylindrical casing 4 having an inlet 6 and an outlet 250, drive means comprising a motor and power source 220, a rotor assembly 12 and a guide assembly 14. The inlet 6 to the casing 4 has a removable lid 16. Rotor assembly 12 is attached to a driving spindle 18 extending from motor 10 and comprises a carrier disc 20 and a guide disc 22. The carrier and guide discs 20, 22 are held apart from one another by a spacer member 24. Guide assembly 14 comprises a guide bar 26 and a squash plate 28. A barrier plate 30 extends from an inner wall 32 of the casing 4. In use, rotor assembly 12 is rotatable by motor 10 while guide assembly 14 is anchored at a fixed position within casing 4.

Carrier disc 20 has a lower surface 34 and a generally circular lower portion 36. Around the periphery of carrier disc 20, between lower portion 36 and upper surface 38 are provided at least one, or, in the preferred embodiment, a plurality of pockets 40 that are preferably equidistantly spaced. Each pocket faces radially outwards of the carrier disc 20 and is shaped to receive a paint ball 42. In the embodiment shown, carrier disc 20 has eight pockets 40. A rear portion 44 of each pocket 40 has approximately the same radius of curvature as the outer surface of a paint ball 42 to receive a paint ball 42 therein. Guide disc 22 has an upper surface 46 and a lower surface 48 and, when viewed in plan, has the same shape as the upper surface 38 of the carrier disc 20. Eight guide recesses 50 are provided. Guide disc 22 is positioned relative to carrier disc 20 by spacer member 24 such that guide recesses 50 are aligned with pockets 40.

Radially extreme edges 51 of each pocket 40 curve upwardly and rearwardly from the lower portion such that a space 53 is defined between pocket edges 51 and casing 4. It will be understood that the radial dimension of space 53 is less than the diameter of the paint balls 42 to prevent paint balls 42 from moving between pockets 40 in use, or becoming jammed between pocket edges 51 and casing 4.

In use, a plurality of paint balls 42 are introduced into casing 4 via inlet 6. Under the influence of gravity, the lowermost paint balls 42 are received into pockets 40. The remaining paint balls 42 are either stacked above pockets 40 in spaces defined between guide disc recesses 50 and casing 4, or remain above guide disc 22 in readiness to descend through a recess 50 to a pocket 40.

Rotor assembly 12 is initially rotated by motor 10 to fill tube 215 with paint balls 42. Taking the example of a single paint ball 42 retained in a pocket 40, as carrier disc 20 rotates the paint ball 42 is moved into contact with guide bar 26. Continued rotation of carrier disc 20 results in paint ball 42 moving out of pocket 40 and into feed tube 215. The number of rotations required to fill tube 215 will depend on such factors as the length of tube 215 and the number of pockets on carrier disc 20. Once feed tube 215 is filled, gun 100 is primed and ready to fire. Subsequent rotation of the rotor assembly 12 is carried out in combination with a control system linked to a trigger mechanism of gun 100 as illustrated in the aforementioned Anderson patents.

In the prior art, sensors 230, 235 were used to directly trigger a relay and activate the motor. This resulted in rapid starting and stopping of the motor during periods of rapid firing. As a result of the starting and stopping, and since motors draw more current and are less efficient during starting, the circuit tended to drain the battery more than is desired for the resultant feed rate.

Figure 6:
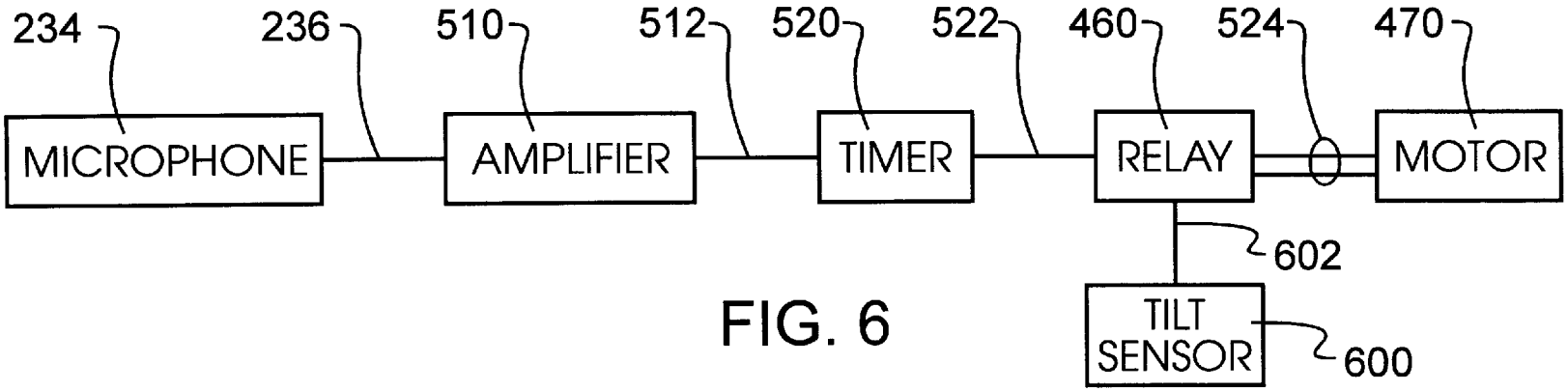
FIG. 6 illustrates by block diagram an electrical circuit for a sound triggered agitator.

In an alternative embodiment, magazine 100 is triggered by sound. Each time paint ball gun 100 fires, a distinct set of frequencies of relatively large magnitude are generated by gun 100. A relatively low cost microphone 234 may be provided instead of either optical pair 230, 235 or magnetic pair 232, 237, as shown by block diagram in FIG. 6. While 234 is identified herein as a microphone, it will be recognized by those familiar with the sound detection art that device 234 may encompass any type of device which is capable of converting sound waves into detectable electrical changes. Moreover, other wave detector types of devices such as pressure sensors or shock sensors could also be used. The purpose of the particular device, regardless of construction or embodiment, is to act as a firing sensor which senses or detects the firing of the gun.

Figure 8:
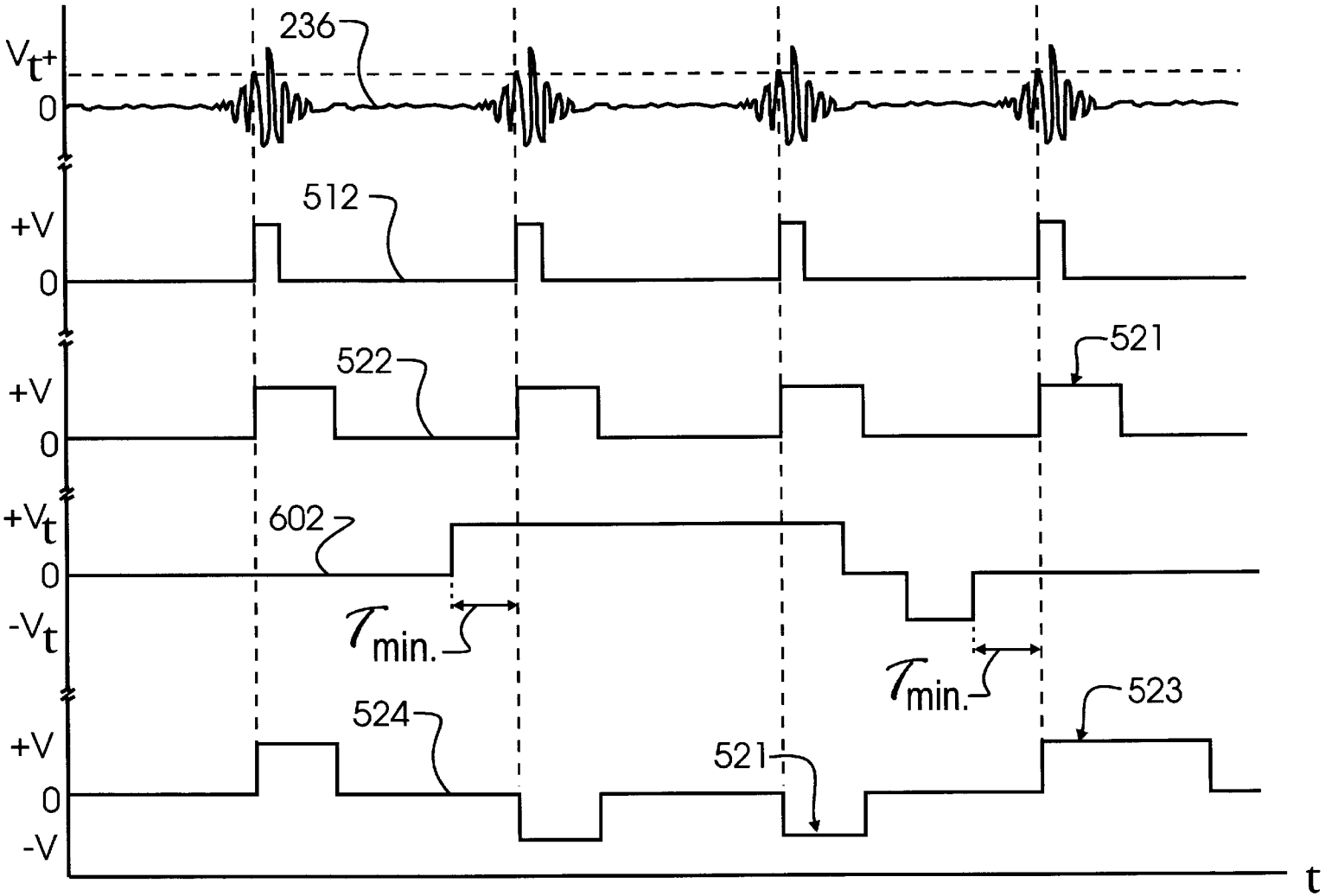
FIG. 8 shows the waveforms of various outputs from FIGS. 6 and 7.

While the firing sensor may take on many different constructs, a microphone is illustrated herein. Microphone 234 may be located directly on magazine 200, for example adjacent to or within battery, motor and electronics compartment 220, thereby eliminating any need for wires external of compartment 220. The output 236 from microphone 234 will generally be too weak or of inappropriate character to directly use in other processing circuitry, so amplifier 510 may be provided. Amplifier 510 may perform a variety of additional functions incident to amplification, such as that of envelope detectors, comparators, limiting, buffering, and/or triggering of the nature of a Schmidt trigger. For example, if amplifier 510 is a high gain amplifier such as an op-amp type designated as a 741 style, or conceivably several of these in series, once a minimum peak threshold $V_t$ is reached as shown in FIG. 8, amplifier 510 may drive output 512 to full supply voltage. When the envelope of microphone output 236 falls below threshold $V_t$, amplified output 512 may be at a ground potential or negative supply, depending upon the type of amplifier circuitry selected. So while amplification is the primary function performed by amplifier 510, a variety of additional functions may be performed which are incident thereto and beneficial, as is known in the amplification art.

An amplified microphone signal 512 is conveyed from amplifier 510 to timer 520. Timer 520 then converts brief electrical impulses indicative of firing into longer duration pulse, for example of one-half second duration. This longer duration signal represents a demand for paint balls, since one ball has been used during firing, and relay 460 is then activated to provide full battery power to motor 470.

Activation of relay 460 is most preferably controlled responsive to tilt sensor 600, which may be a mercury tilt switch, an accelerometer, various gravity or force sensors, gyroscopic sensors, or other technique to determine orientation relative to gravity. In one conceived embodiment, tilt sensor 600 and device 234 can comprise a single dual-axis accelerometer. One axis serves as the firing detector, while the second axis detects tilt. As aforementioned, the angle of orientation of the magazine has a consequential effect on the rate and potential success of feeding paint balls. Most preferably, motor shaft 305 is rotated to feed paint balls toward feed tube 215, rather than away therefrom. In other words, and with reference to FIG. 3, should magazine 200 be tilted to load the right side thereof with paint balls, motor shaft 305 will most preferably be rotated counter-clockwise, in the direction of arrow 350. As the paint balls are swept from the right side of magazine chamber 210, they will then be deposited directly into feed tube 215. This results in a more efficient deposit of balls therein. In the event magazine 200 is then tilted in a direction opposite, to cause the balls to accumulate on the left side of magazine chamber 210, motor shaft 305 will most preferably be rotated in a clockwise direction as illustrate by arrow 355. Once again, this will sweep the paint balls 240 into feed tube 215 with a minimum of traversing and a maximum efficiency. The example with reference to magazine chamber 210 will be understood to be applicable to many other designs, including the first alternative embodiment casing 4.

Switch-type sensors, and some other sensors known in the sensing art, have a designed minimum degree of tilt before the switch is activated. Whether this minimum threshold is achieved mechanically, as in the case of a mercury switch, or electronically, is not critical to the performance of the invention. However, incorporating a minimum tilt angle required for activation prevents reversals when the tilt angle is only minor and not significant enough to reflect a consequential movement of paint balls within a magazine chamber.

As should be apparent, it would be undesirable to design a system which attempts to rotate first in one direction and then another in too small a time frame. Such rapid switching would not only draw excessive power and potentially generate unwanted noise and vibration, but such movement would also potentially result in an effective stalling of motor shaft 305, effectively completely disabling agitator 300. Clearly, that is not the intent. Most preferably, delay between motor direction reversals will be designed into the system to reflect the time necessary for the tilt to have an effect on feed rate in a positive way. Said another way, there is a finite and measurable maximum reversal speed which will provide a beneficial increase in feed rate. This rate will depend upon a large number of variables, including the size and shape of the agitator 300 and magazine 210, mass and geometry of the motor, type of motor winding and core, transit speed of the paint balls, and other diverse factors too numerous to mention. If not determinable theoretically or any other way, the system can be tested experimentally through builds where different reversal rates and the changing of the myriad of other variables can be tested using known test matrices, to optimize performance.

Delay between motor reversals is controllable through motor design, but is more preferably varied using electrical or electronic means and adjusted to accommodate a particular motor type and characteristic. In the most preferred embodiment, relay 460 is in fact an H-bridge circuit constructed from MOSFET transistors, and most preferably the MOSFETs are of the type which incorporate flyback diodes directly into their construction to prevent damaging spikes from being generated. The H-bridge construction is known in the field of motor control, and based upon the present teachings will be applied herein in the field of paint ball guns. The use of this type of electronic motor control enables an output 602 from tilt sensor 600 to be fed through additional electronic control circuitry which may either form a part of tilt sensor 600, a part of relay 460, or a separate component. This additional electrical motor control function will most preferably incorporate an optimum minimum time for the particular paint ball magazine design, during which time magazine 210 or casing 4 must remain tilted before the H-bridge output is reversed. This can be accomplished, for example, through the use of a typical R-C circuit and threshold detector, and can even be adjustable through the use of a variable resistor or rheostat.

The electronic components used to detect the minimum duration time will affect the behavior of the motor and agitator very directly, and should therefore be chosen carefully. More particularly, the R-C circuit mentioned or similar components will tend to act as an accumulator, averaging the tilt signal. Averaging of the tilt signal will permit the tilt signal to be discontinuous, permitted to occasionally, albeit briefly, turn off. Turning off briefly will only be interpreted by an R-C accumulator or the like as slightly lowering the average. Consequently, the time required to trigger a motor reversal may be longer, owing to the lower average due to the brief turn-offs of the tilt sensor, but the average will still indicate generally continuous tilt, and, with this type of circuit could consequently trigger a motor reversal. Said another way, if the gun operator tilts the gun in one direction for a vast majority of a time period, but during that time period one or more times jolts the gun or otherwise very temporarily disables the tilt sensor, an R-C or accumulator circuit will still identify this as an indication that the gun is tilted. Since this behavior is felt to most closely resemble the actual paint ball and magazine behavior, it is most preferred to use this type of minimum time duration measurement, and select an R-C time constant which most closely matches the movement of paint balls within the magazine.

Nevertheless, and as an alternative, it is conceived herein to use circuitry which requires the tilt signal to remain continuously on during the time period before reversing the motor. This type of circuit would most preferably be used where the sensor itself incorporates some delay, such as a sensor having a large hysteresis, or a high mass which is little effected by momentary or temporary jolts. There may, however, be times or situations where a designer deems it appropriate and most effective to require the sensor signal to be continuous, even when the sensor does not incorporate any inertia or hysteresis. Regardless of the technique used, the end result will be to reverse the output 524 from relay 460 when paint ball gun 100 has been tilted for a time deemed sufficient to warrant agitator reversal.

FIG. 8 illustrates the relationship between signals 236, 512, 522, and 524. Timer 520 may be a simple RC filter, or may comprise a more complicated circuit such as a 555 type timer or even a voltage controlled oscillator. The exact components used to fulfill the timing function are not critical to the invention, so long as the timing diagrams illustrated in FIG. 8 hold true to intent. As evidenced therein, when output 602 switches from a zero-voltage state to a positive $V_T$ value, this will indicate gun tilt in a first direction. When this tilt occurs for a sufficient time $T_{min}$, and presuming the gun is already not rotating in a direction appropriate for this direction of tilt, output 524 will reverse from a positive output shown to an inverse thereof, and thereby reverse the motor. Since many of these magazine motors are DC permanent magnet motors, this may, for example, be accomplished by shutting off the output 524 briefly, allowing the flyback diodes to dissipate any voltage spikes from the decay of the inductive field and the stopping of the motor, and then reversing the output 524 polarity. Later, when the gun is tilted back to an opposite direction for a sufficient time $T_{min}$, the output 524 may once again be reversed, preferably again after a small delay.

Figure 7:
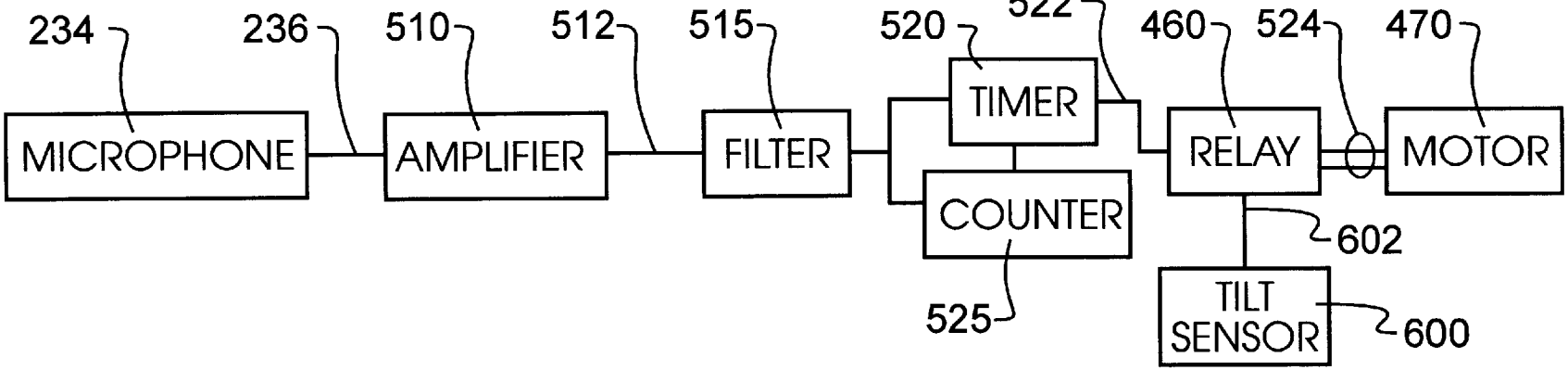
FIG. 7 illustrates by block diagram an alternative sound triggering circuit.

FIG. 7 illustrates an additional filter 515. This filter 515 may be a low, high or band-pass filter, depending upon the particular gun firing frequencies. Most typically, this will be a band-pass filter having a very narrow bandwidth, such that one or a few specific frequencies are selected which are only indicative of firing. The inclusion of filter 515 will help to prevent false triggering of motor 470 when other events occur that produce sound, such as when gun 100 is accidentally bumped against another object. While filter 515 is not essential to the proper functioning of circuit 500, some frequency discrimination may be desired, particularly for higher level competitions or premium guns and magazines. Filter 515 may be provided prior to amplifier 510, after amplifier 510 as illustrated, or integral therewith, particularly where operational amplifiers are used and gain may be readily combined with frequency selectivity.

An additional optional feature is illustrated in FIG. 7, by providing counter 525. Counter 525 provides feedback to timer 520 which is used therein to effect a change in timing duration. More specifically, every n times a pulse indicative of firing occurs, counter 525 adjusts the timing control of timer 520 to change duration of pulses on waveform 522. For example, as shown in FIG. 8, pulse 523 may be twice the duration of pulse 521. In the preferred embodiment, n might be equal to four, so that every fourth shot, timer 520 provides a one second pulse instead of the normal one-half second pulse. The increased duration may be achieved through the use of a transistor or other switch connecting or removing an additional timing component into/from the circuit, as is known in the art, or may alternatively be the result of a voltage control signal applied to a voltage controlled oscillator. These and a myriad of other frequency control techniques are well known in the art of timing duration control, and that knowledge is recognized as incorporated herein. This change in duration ensures that every nth shot, the magazine is thoroughly stirred to help ensure balls remain available. The value of n is preferably equal to the number of balls that are retained within feed tube 215, to ensure that feed tube 215 never empties, while still minimizing the duration of the majority of stir cycles to help conserve battery power.

By now, those skilled in the art of electronic circuitry and microprocessor control will recognize that the electronic circuitry can be implemented through a microprocessor or microcontroller and associated circuitry. Since microprocessors and micro-controllers are accompanied by a clock, timing measurement and control is readily accomplished. Where desired, accumulation is accomplished by simple measurement and repeated arithmetic summing. Finally, the digital output ensures clean electronic switching, a feature which is very important for improved battery performance. Certainly all logic comparisons and calculations are easily accomplished through the use of a micro-controller or microprocessor.

An additional benefit of the present motor control is obtained by providing a motor double-rotation function. This motor double-rotation will most preferably involve powering of the motor separate from any firing detection. Moreover, the power will be applied to most preferably rotate the motor in one direction for a brief interval, followed by reversal of the motor for a second brief interval. The initiation of motor double-rotation may be accomplished in one alternative embodiment through activation of a switch on the motor housing or magazine, such that if a gun should jam, the operator can press a button or otherwise trigger a switch, leading to a rapid reversal of the agitator and a consequent freeing of the jam. In another alternative embodiment, the motor current or other measure of rotation may be electronically monitored. In the event the motor stops rotation when power is applied or other monitored parameter indicates a jam, the direction of rotation may be automatically reversed to free the agitator automatically. In yet a third alternative embodiment, the motor may be periodically reversed for brief intervals, irrespective of the actual existence of such a jam. The intervals, in this third alternative, are such that the motor and agitator will primarily and substantially rotate in a single direction, but short bursts of rotation in the opposite direction ensure continued free movement of the agitator. The double-rotation, whether manually activated or automatic, results in tremendous resistance to jamming, while tilt sensing offers improved feed rates. The combination of features requires little additional circuitry over that previously required in the prior art, and yet provides substantial benefit not heretofore available.

The tilt sensor and motor direction control discussed herein above is illustrated as required by the patent statutes in combination with a preferred and alternative embodiment magazines. It will be understood herein that the tilt sensor and motor direction control will be operative independent of the magazine, and consequently has applicability with many very diverse magazine designs and constructs. While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

We claim:

1. A controller for a paint ball gun magazine agitator motor, said magazine agitator motor coupled to a paint ball gun magazine agitator within a paint ball gun magazine, comprising:

a tilt sensor which senses tilt of said paint ball gun magazine, and, responsive to said tilt generates an active electrical direction indicator signal representative of a one of at least two different directions of said tilt;

a tilt duration detector for detecting when said active electrical direction indicator signal is active longer than a threshold time period, and, responsive to said detection, produces a signal indicating a minimum duration tilt which is of greater duration than necessary and of appropriate direction to obtain an increase in paint ball feed rate by reversing said paint ball gun magazine agitator motor; and an electrical circuit which controls an electrical potential applied to said paint ball magazine agitator motor responsive to said minimum duration tilt signal, wherein said paint ball magazine agitator motor reverses when said minimum duration tilt signal is produced and represents a benefit in said reversing.

2. The controller of claim 1 wherein said tilt sensor further senses tilt relative to a direction of the earth's gravitational force.

3. The controller of claim 1 wherein said tilt sensor has a minimum threshold for producing said active electrical direction indicator signal.

4. The controller of claim 1 wherein said tilt sensor is selected from the group consisting of a mercury switch, an accelerometer, a force sensor, or a gyroscopic sensor.

5. The controller of claim 1 wherein said tilt duration detector detects when said active electrical direction indicator signal is active continuously longer than said threshold time period.

6. The controller of claim 1 wherein said tilt duration detector detects when said active electrical direction indicator signal is active for a cumulative time period longer than said threshold time period.

7. The controller of claim 1 wherein said electrical circuit further comprises an H-bridge.

8. The controller of claim 1 wherein said electrical circuit further comprises at least one integral flyback diode.

9. The controller of claim 1 further comprising:

a paint ball gun supporting said paint ball gun magazine and receiving paint balls therefrom; and a firing sensor which produces a paint ball demand signal responsive to a sensing of a firing of a paint ball from said paint ball gun, said electrical circuit further responsive to said firing sensor to control said electrical potential.

* * * * *